US008046923B2

(12) United States Patent
Liu

(10) Patent No.: US 8,046,923 B2
(45) Date of Patent: Nov. 1, 2011

(54) FOLDING KNIFE

(75) Inventor: Guanpeng Liu, Guangdong (CN)

(73) Assignees: Power Source Industries Co., Ltd., Yangjiang, Guangdong (CN); Nextorch Industries Co., Ltd., Yangjiang, Guangdong (CN)

( * ) Notice: Subject to any disclaimer, the term of this patent is extended or adjusted under 35 U.S.C. 154(b) by 544 days.

(21) Appl. No.: 12/106,563

(22) Filed: Apr. 21, 2008

(65) Prior Publication Data

US 2009/0144985 A1 Jun. 11, 2009

(30) Foreign Application Priority Data

Dec. 6, 2007 (CN) ..... 2007 2 0183483 U

(51) Int. Cl.
*B26B 1/04* (2006.01)

(52) U.S. Cl. ..... 30/160; 30/161

(58) Field of Classification Search ..... 30/158, 30/164, 159, 160, 155, 161
See application file for complete search history.

(56) References Cited

U.S. PATENT DOCUMENTS

| | | | | |
|---|---|---|---|---|
| 5,044,079 | A * | 9/1991 | Gibbs | 30/160 |
| 5,819,414 | A * | 10/1998 | Marifone | 30/160 |
| 7,603,778 | B1 * | 10/2009 | Lerch | 30/160 |
| 2008/0201953 | A1 * | 8/2008 | Bremer et al. | 30/160 |

* cited by examiner

*Primary Examiner* — Stephen Choi
(74) *Attorney, Agent, or Firm* — Hoffmann & Baron, LLP

(57) ABSTRACT

A fold knife comprising a handle and a blade hinged to the handle. The fold knife further comprises a switch mechanism for manual and semi-automatic operation which is positioned in the inner chamber of the handle. The switch mechanism for manual and semi-automatic operation has a first position in which it is allowed to manually open the blade from the handle and a second position in which it is allowed to automatically open the blade from the handle. The fold knife is capable of easily switching between the manual operation condition and the semi-automatic operation condition by means of the switch mechanism for manual and semi-automatic operation.

13 Claims, 10 Drawing Sheets

FOLDING KNIFE

CROSS-REFERENCE TO RELATED APPLICATIONS

This application claims priority based on Chinese Patent Application No. 200720183483.9 filed on Dec. 6, 2007 which is incorporated herein by reference.

TECHNICAL FIELD

The present invention relates to a folding knife.

BACKGROUND OF THE INVENTION

A fold knife has become a common tool in the daily life, bringing about great convenience for people. The existing folding knifes can be classified into a manual type fold knife and a semi-automatic type fold knife. Just as the name implies, the manual type fold knife needs to be operated by a user's hand throughout its whole opening procedure, whereas as for the semi-automatic fold knife, the user only needs to exert a force at the beginning stage of the opening while in the sequential stage the fold knife is automatically opened by means of a device inside the knife.

It is appreciated from the above that since the user needs to operate the manual fold knife throughout the whole opening procedure, it needs a great effort to open it but on the other hand it is comparatively safe to use for the users such as kids. Contrarily, the semi-automatic fold knife can be facilitated in opening while degraded in terms of safety. As a result, there is a need of a fold knife capable of switching between the manual operation condition and the semi-automatic operation condition depending on the requirements of a user.

SUMMARY OF THE INVENTION

The present invention is made exactly for aiming to the above problems. The object of the present invention is to provide a fold knife which can meet various requirements, that is, it can be switched either into the manual operation condition under which it is comparatively safe for the user (such as a kid) to use or into the semi-automatic operation condition under which it is relatively facilitated during the opening.

According to the present invention, it is provided a fold knife which comprises a handle and a blade hinged to the handle. The fold knife further comprises a switch mechanism for manual and semi-automatic operation which is positioned in the inner chamber of the handle and has a first position in which it is allowed to manually open the blade from the handle and a second position in which it is allowed to semi-automatically open the blade from the handle.

Preferably, the switch mechanism for manual and semi-automatic operation includes: a resilient portion pivotally mounted in the handle; and a switch member provided on the handle with its one part exposed to the outside and has a first switch position in which the end of the resilient part adjacent to the blade slightly contacts the blade or is out of contact with it and a second switch position in which the switch member biases the resilient portion such that when the blade is closed, the end of the resilient portion presses against the corresponding end of the blade toward the open side of the handle so as to maintain the switch mechanism for manual and semi-automatic operation in the second position.

Preferably, the switch member is a slider which is slidably connected to the handle by inserting the projections provided on the opposed sides of the slider into the corresponding slots of the handle respectively.

Preferably, the switch member is a pin which is slidably connected to the handle by passing through the corresponding slot of the handle.

Preferably, the switch member is provided on one side of the resilient portion opposed to the open side of the handle and provided between the pivot axis and the blade in the manner of approaching the pivot axis of the resilient portion.

Preferably, the resilient portion has an extension part at one side of the pivot axis of the resilient portion opposed to the blade and the switch member is provided below the extension part.

Preferably, at one of the first switch position and the second switch position, the resilient portion is provided with a recess capable of accommodating the switch member.

Preferably, the resilient portion has an extension part at one side of the pivot axis of the resilient portion opposed to the blade with the tail tip of the extension part having a bending part toward the open side of the handle, and also the switch member is a cam assembly which comprises: a rotating wheel pivotally mounted on the handle with the pivot axis positioned below the extension part; and a first and second projections which form an angle with respect to the center of the rotating wheel wherein the angle is set such that when the switch mechanism for manual and semi-automatic operation is in the first position only the first projection contacts and presses against the extension part whereas when the switch mechanism for manual and semi-automatic operation is in the second position the second project contacts the bending part.

Preferably, the resilient portion includes a tab which is pivotally mounted in the handle and a pre-pulling member which is at one end fixed to the handle and at the other end fixed to the tab and allows the end of the tab adjacent to the blade to have the trend of rotating away from the open side of the handle.

Preferably, the pre-pulling member is a coil spring or spring string.

The fold knife according to the present invention can easily switch between the manual operation condition and the semi-automatic operation condition by means of the switch mechanism for manual and semi-automatic operation, so as to satisfy various requirements of a user wherein it on one hand can guarantee the safety of the users such as a kid and on the other hand can provide the facilitation in the opening procedure.

It should be appreciated that the above general description and the following detailed description are of exemplification and illustration.

BRIEF DESCRIPTION OF THE DRAWINGS

The accompanying figures constituting a part of the present specification helps to make the present invention more understandable wherein the figures illustrate embodiments of the present invention and are used together with the specification for describing the principle of the present invention, in which.

DESCRIPTION OF PREFERRED EMBODIMENTS

Hereinafter, a detailed description is made to certain embodiments of the present invention in conjunction with the figures. In Figures, a same reference number denotes the same or corresponding component.

First Embodiment

Below, the first embodiment according to the present invention is described referring to FIG. 1A-FIG. 1E. The fold knife 100 according to the present invention comprises a handle 10, a blade 20 hinged to the handle 10, and a switch mechanism for manual and semi-automatic operation 30 positioned in the inner chamber of the handle 10 and used for allowing the fold knife 100 to switch between the manual operation condition and the semi-automatic operation condition.

Figure 1A:
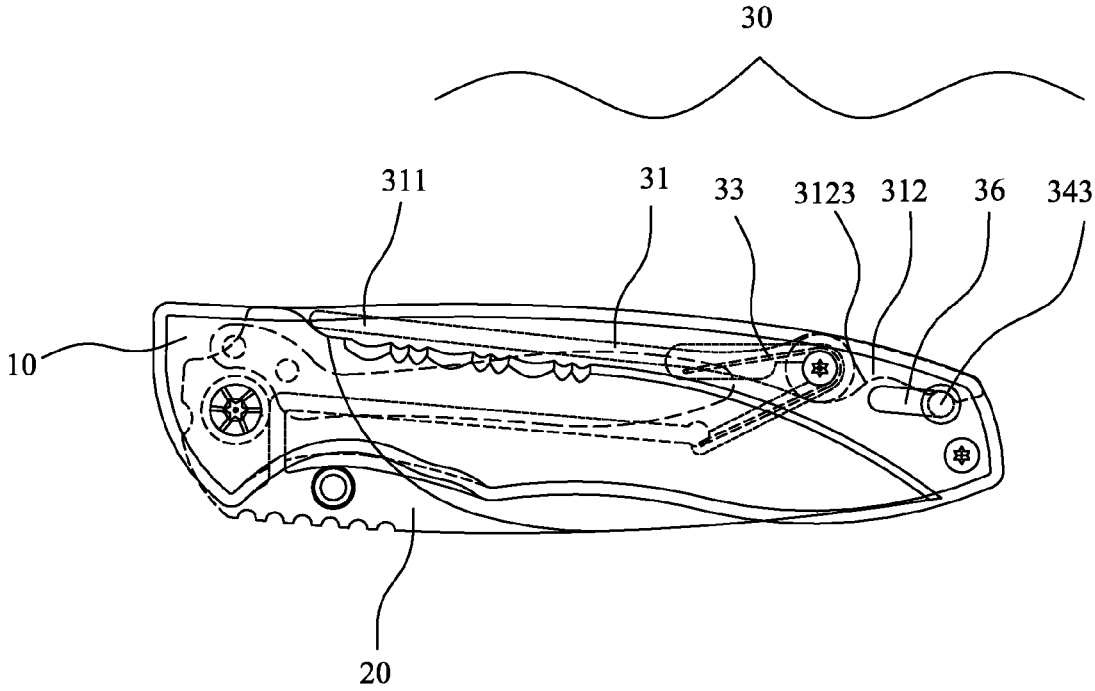
FIG. 1A is the fold knife according to the first embodiment of the invention wherein the fold knife is under the semi-automatic operation condition and the blade is closed inside the inner chamber of the handle.
Figure 1B:
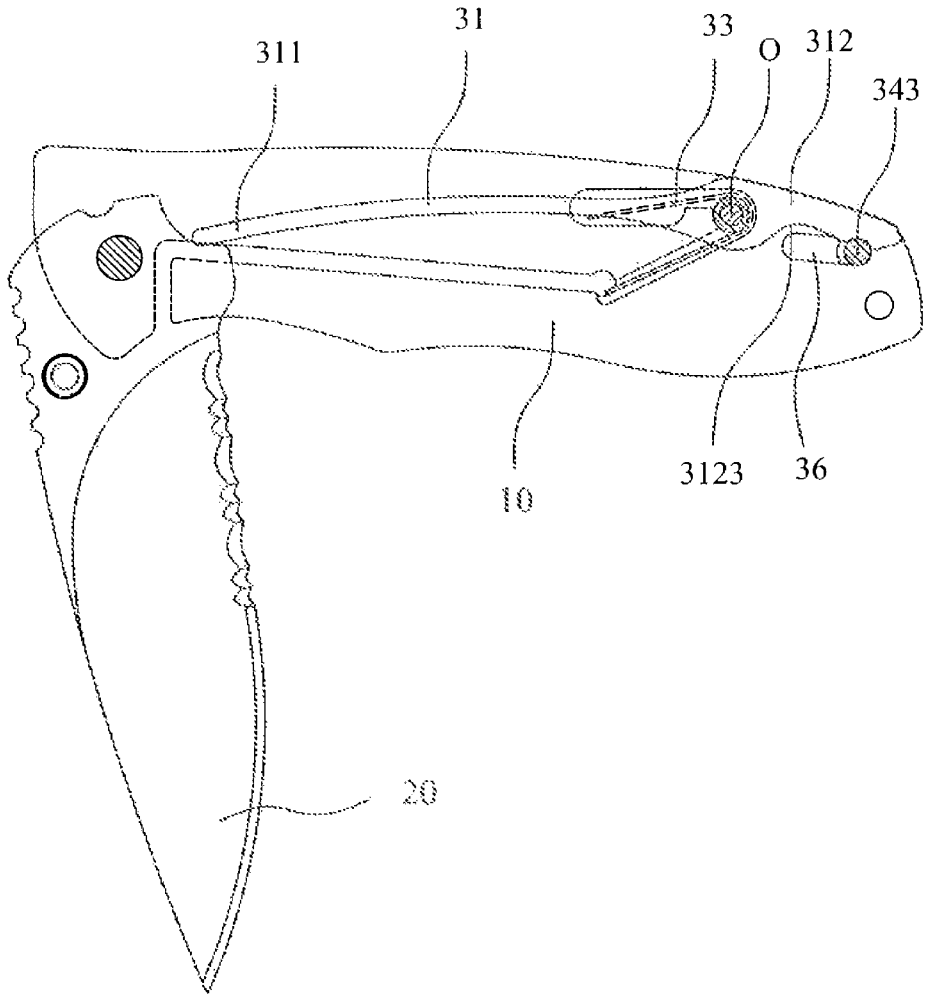
FIG. 1B is the fold knife according to the first embodiment of the present invention wherein the fold knife is under the semi-automatic operation condition and the blade is semi-opened from the inside of the handle and furthermore the part of the handle on one side is removed for clarification.
Figure 1C:
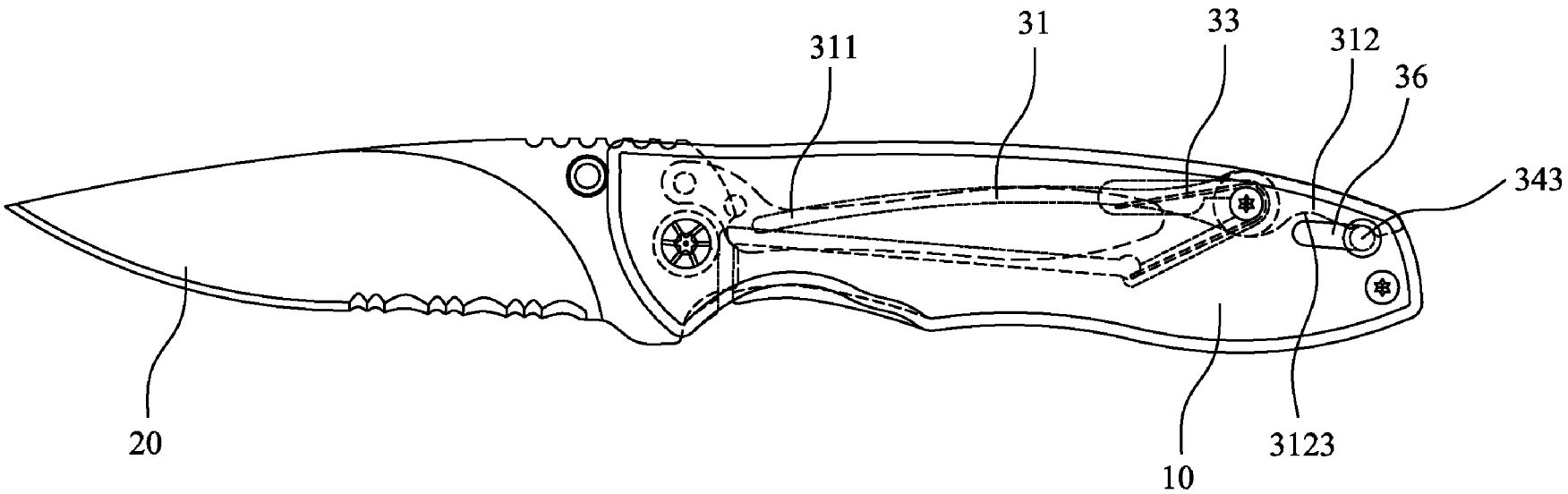
FIG. 1C is the fold knife according to the first embodiment of the present invention wherein the fold knife is under the semi-automatic operation condition and the blade is fully opened from the inside of the handle and moreover the blade is automatically opened by the resilient force of the tab during the movement from the operation condition shown in FIG. 1B to the operation condition shown in FIG. 1C.
Figure 1D:
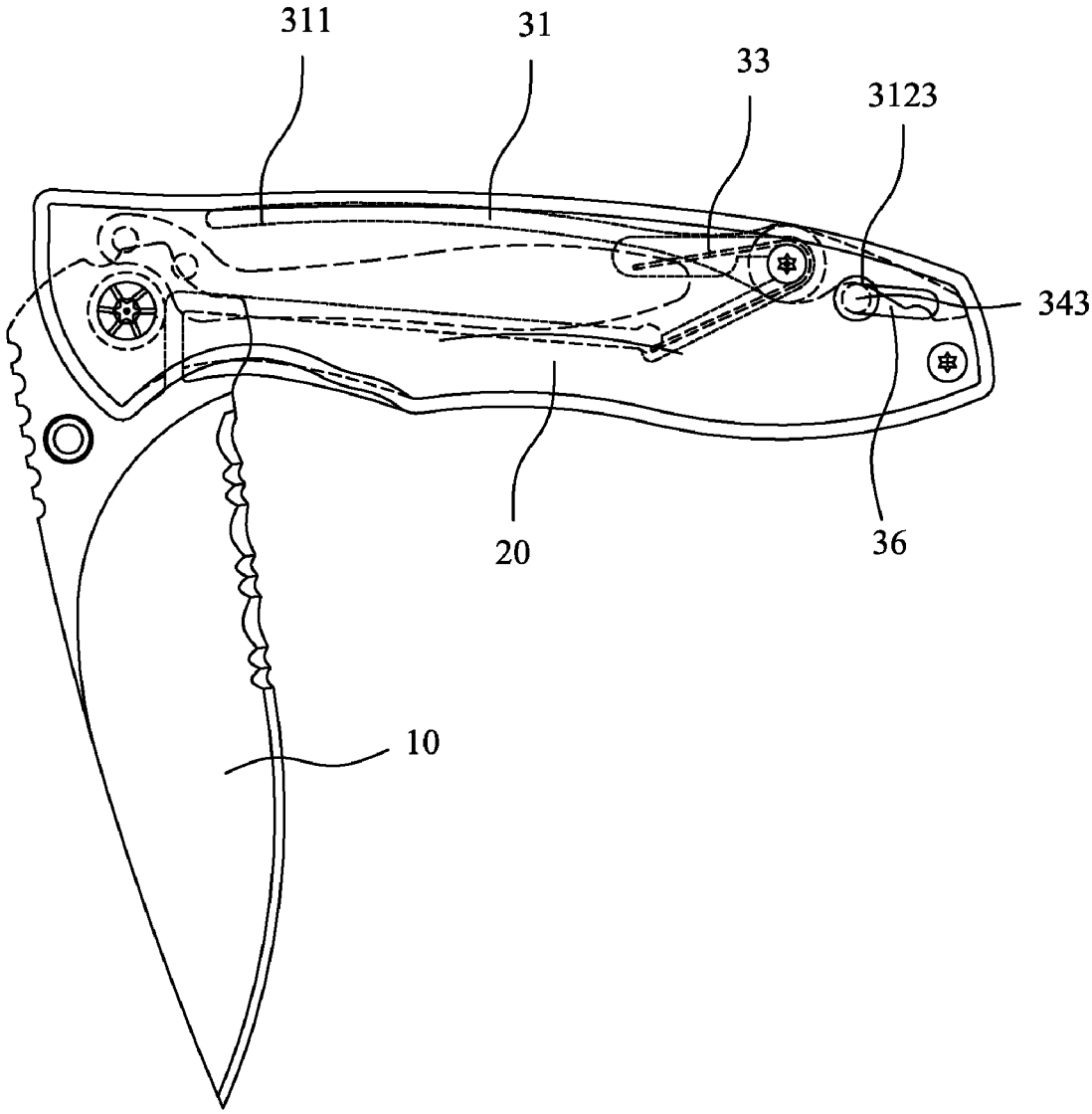
FIG. 1D is the fold knife according to the first embodiment of the present invention wherein the fold knife is under the manual operation condition and the blade is semi-opened from the inside of the handle.
Figure 1E:
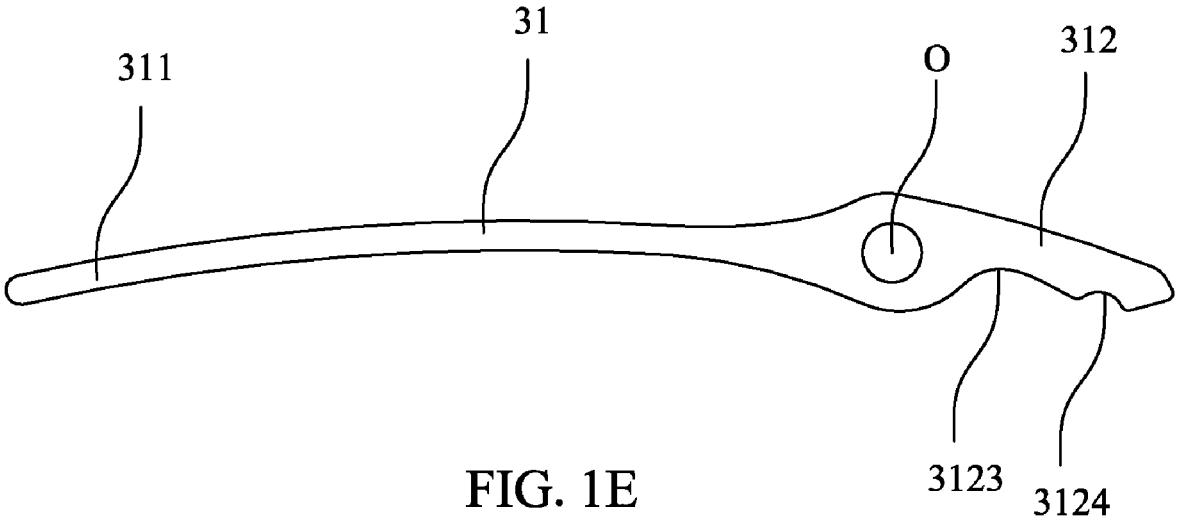
FIG. 1E is the tab of the fold knife according to the first embodiment of the present invention.

As shown in FIG. 1A-FIG. 1D, the switch mechanism for manual and semi-automatic operation 30 comprises: a tab 31 pivotally mounted in the inner chamber of the handle 10 wherein an extension portion 312 is provided on one side of the pivot axis of the tab 31 opposed to the blade 20 and a recess 3123 is provided in the bottom side of the extension portion 312, as shown in FIG. 1E; a spring string 33 which is at one end fixed to the handle 10 and at the other end fixed to the tab 31 and allows the end 311 of the tab 31 adjacent to the blade 20 to have the trend of rotating away from the open side of the handle; and a pin 343 which is provided below the extension portion 312 and passes through the corresponding slot 36 of the handle 10 so as to be slidably connected to the handle 10. In addition, for the sake of the convenience in use, the pin 343 has a part exposed to the outside of the handle 10.

Referring to FIG. 1D, when the pin 343 is located in the recess 3123, the pin 343 does not press against the tab 31. Herein, the tab 31 has the trend of rotating away from the open side of the handle 10 under the effect of the pulling force of the spring string 33. As a result, when the blade 20 is closed, the end 311 of the tab 31 adjacent to the blade 20 slightly contacts the blade 20 or is out of contact with it, such that the tab 31 does not exert or exert little force on the blade 20. Consequently, during the opening of the blade 20, the tab 31 does not function as the assistant force, i.e., the fold knife 100 is under the manual operation condition.

In addition, referring to FIG. 1A-FIG. 1C, when the pin 343 is slid away from the blade 20 until moving out of the recess 3123, the pin 343 biases the tab 31, such that when the blade 20 is closed, the end 311 of the tab 31 presses against the corresponding end of the blade 20 toward the open side of the handle 10. Therefore, when the blade 20 is manually opened from the position shown in FIG. 1A to the position shown in FIG. 1B, the blade 20 can be automatically opened up to the position shown in FIG. 1C by means of the resilient force of the tab 31. That is, the fold knife 100 in FIG. 1A-FIG. 1C is under the semi-automatic operation condition.

Figure 2:
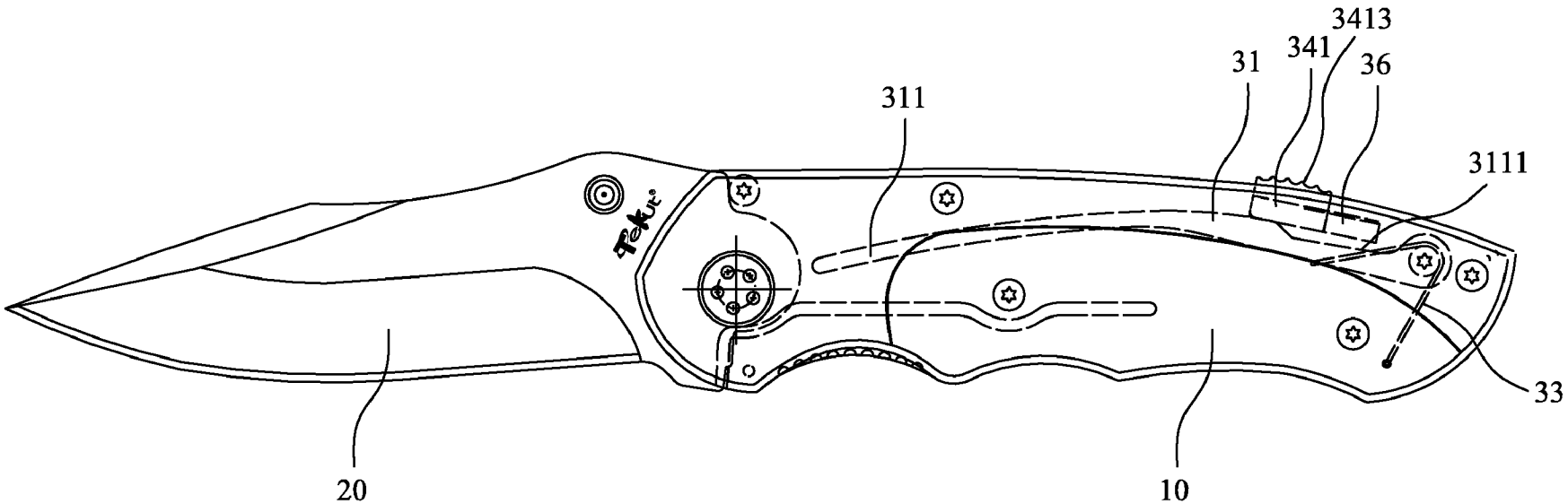
FIG. 2 is the fold knife according to the second embodiment of the present invention wherein the fold knife is under semi-automatic operation condition and the blade is fully opened from the inside of the handle.

Obviously, the present embodiment is not limited to the above, for example, the pin 343 may be provided on one side of the tab 31 opposed to the open side of the handle 10 and provided between the pivot axis of the tab 31 and the blade 20 in the manner of approaching the pivot axis of the tab 31, i.e., the pin 343 is located at the position of the slider 341 shown in FIG. 2.

Second Embodiment

The second embodiment according to the present invention is substantially same as the first embodiment in construction except for the switch mechanism for manual and semi-automatic operation 30. Therefore, only the different construction of the second embodiment from the first embodiment is described hereinafter.

Figure 2A:
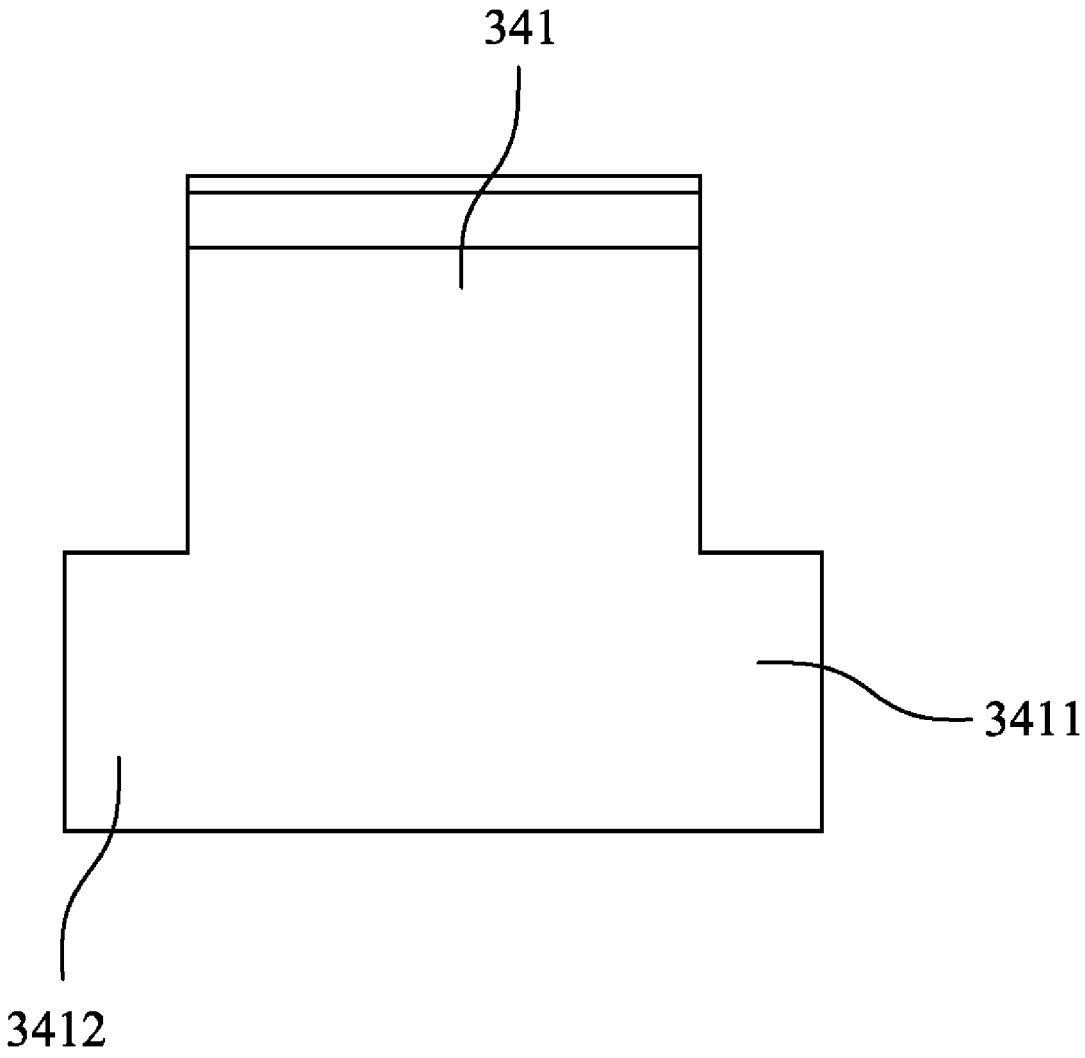
FIG. 2A is the slider of the fold knife according to the second embodiment of the present invention.

Next, the second embodiment according to the present invention is described in conjunction with FIG. 2-FIG. 2A.

As shown in FIG. 2, the switch mechanism for manual and semi-automatic operation 30 includes a tab 31 which is pivotally mounted in the handle 10 and is provided with a recess 3111 in the vicinity of the pivot axis; a spring string 33 which is at one end fixed to the handle 10 and at the other end fixed to the tab 31 allowing the end 311 of the tab 31 adjacent to the blade 20 to have the trend of rotating away from the open of the handle 10; and a slider 341 which is provided on one side of the tab 31 opposed to the open side of the handle 10 and provided between the pivot axis of the tab 31 and the blade 20 in the manner of approaching the pivot axis of the tab 31. Particularly, as shown in FIG. 2A, the opposed sides of the slider are provided with projections 3411 and 3412 respectively wherein the projections 3411 and 3412 are inserted into the corresponding slots 36 of the handle 10 respectively, such that the slider 341 is slidably connected to the handle 10.

Furthermore, for the convenience in use, the slider 341 has a part exposed to the outside of the handle 10. Preferably, the part of the slider 341 exposed to the outside of the handle 10 is provided thereon with a decorative pattern 3413 for enhancing the friction.

When the slider 341 is located inside the recess 3111 the slider 341 does not apply pressure against the tab 31. Herein, the tab 31 has the trend of rotating away from the open side of the handle 10 under the effect of the pulling force of the spring string 31. Therefore when the blade 20 is closed, the end 311 of the tab 31 adjacent to the blade 20 slightly contacts the blade 20 or is out of contact with it, resulting in that the tab 31 exerts little pushing pressure on the blade 20. Consequently, during the opening of the blade 20, the tab 31 does not function as the assistant force, i.e. the fold knife is under the manual operation condition. This manual operation condition is similar to that shown in FIG. 1D.

In addition, as shown in FIG. 2, when the slider 341 is slid toward the blade 20 until moving out of the recess 3111, the slider 341 biases the tab 31 such that when the blade 20 is closed, the end 311 of the resilient portions 31, 33 presses against the corresponding end of the blade 20 toward the open side of the handle 10, and therefore during the opening of the blade 20, the tab 31 functions as the assistant force, i.e. the fold knife 100 is under the semi-automatic operation condition. This semi-automatic operation condition is similar to that shown in FIG. 1A-FIG. 1C.

Of course, the present embodiment is not limited to the above, for example, an extension part 312 is provided on one side of the pivot axis of the tab 31 opposed to the blade 20 and the slider 341 is provided below the extension portion 312. Additionally, the spring string 33 may be replaced by a coil spring.

Third Embodiment

The third embodiment according to the present invention is substantially same as the first embodiment in construction except for the switch mechanism for manual and semi-automatic operation 30. Therefore, only the different construction of the third embodiment from the first embodiment is described hereinafter.

Figure 3:
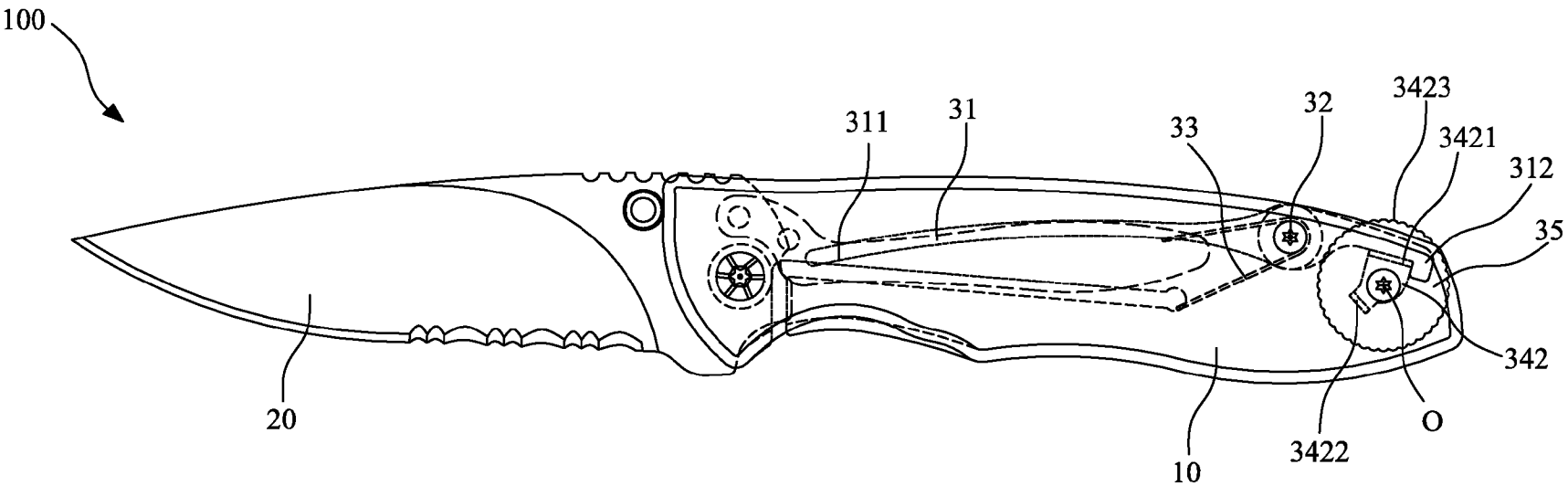
FIG. 3 is the fold knife according to the third embodiment of the present invention wherein the fold knife is under the semi-automatic operation condition and the blade is fully opened from the inside of the handle.
Figure 3A:
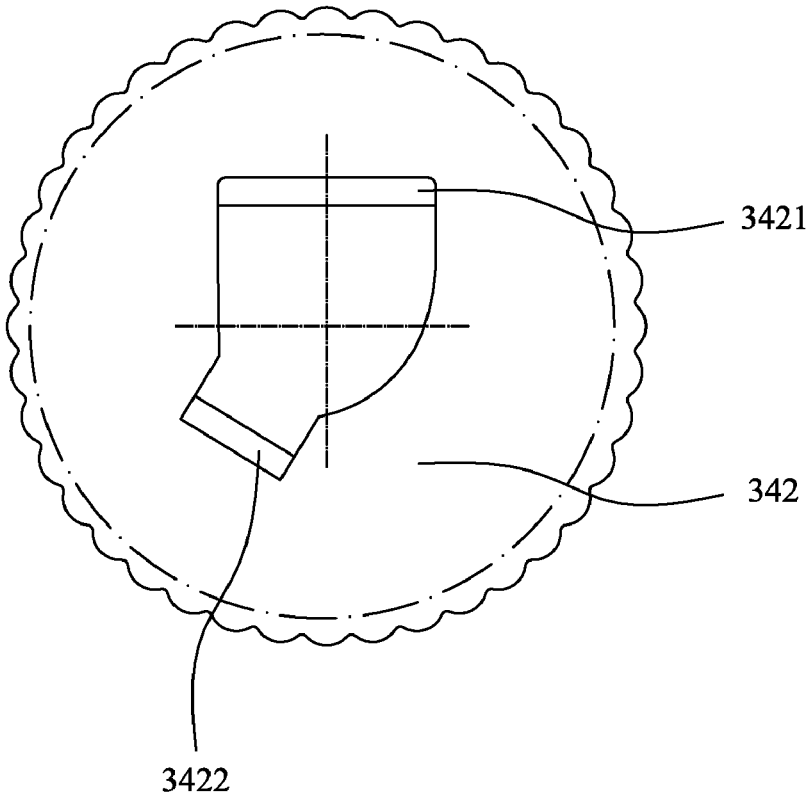
FIG. 3A is the front view of the cam assembly of the fold knife according to the third embodiment of the present invention.
Figure 3B:
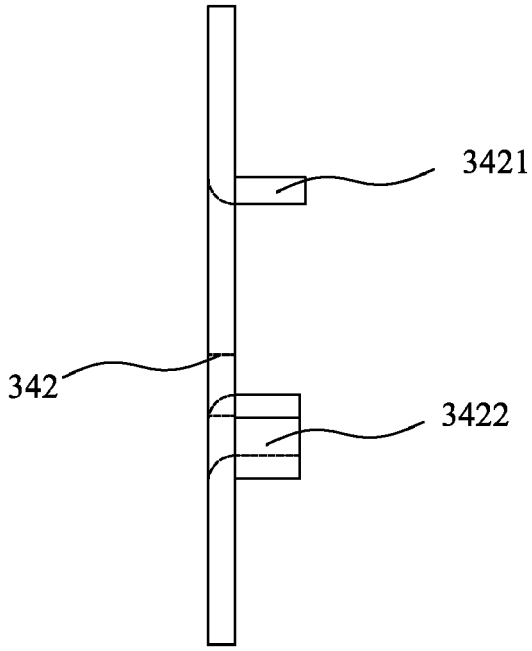
FIG. 3B is the side view of the cam assembly of the fold knife according to the third embodiment of the present invention.
Figure 3C:
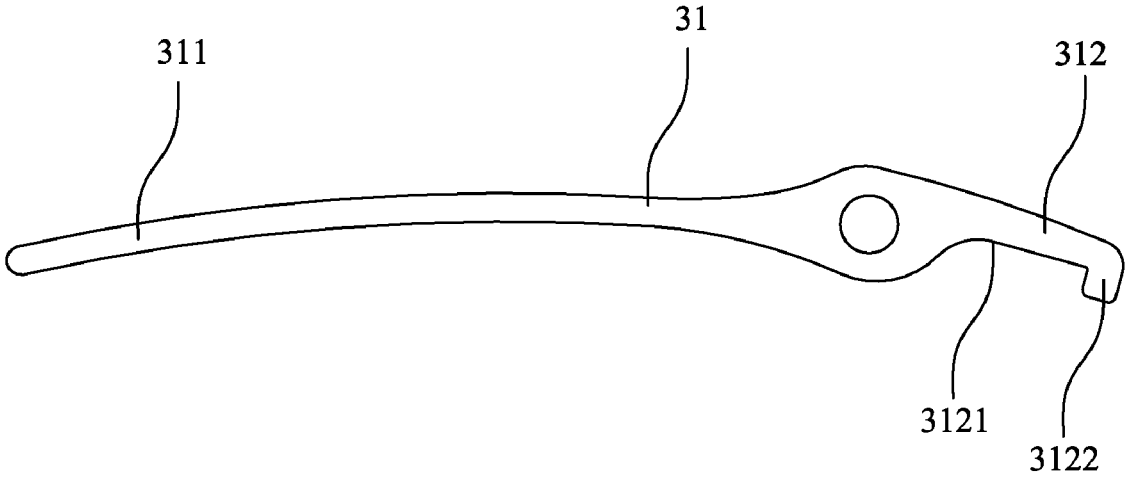
FIG. 3C is the tab of the fold knife according to the third embodiment of the present invention.

Next, the third embodiment according to the present invention is described in conjunction with FIG. 3-FIG. 3C.

The switch mechanism for manual and semi-automatic operation 30 includes a tab 31 which is pivotally mounted in the handle 10 wherein an extension portion 312 is provided on one side of pivot axis of the tab 31 opposed to the blade 20 and has at its tail tip a bending part 3122 toward the open side of the handle 10, as shown in FIG. 3C; a spring string 33 which is at one end fixed to the handle 10 and at the other end fixed to the tab 31 allowing the end 311 of the tab 31 adjacent to the blade 20 to have the trend of rotating away from the open side of the handle 10; and a cam assembly 342.

As shown in FIG. 3A and FIG. 3B, the cam assembly 342 comprises: a rotating wheel 35 pivotally mounted in the handle 10 with the pivot axis provided below the extension part 312; and a first projection 3421 and a second projection 3422 provided on the rotating wheel 35 wherein the first projection 3421 and the second projection 3422 form an angle with respect to the center O of the rotating wheel 35 and the angle is set such that when the switch mechanism for manual and semi-automatic operation 30 is in the first position (i.e., when the fold knife 100 is under the semi-automatic operation condition), only the first projection 3421 contacts and presses against the extension part 312 and when the switch mechanism for manual and semi-automatic operation 30 is in the second position (i.e., when the fold knife 100 is under the manual operation condition), the second projection 3422 contacts the bending part 3122. In addition, in order to assure good contact, the first projection 3421 and the second projection 3422 are preferably designed as an elongated shape, as shown in FIG. 3A.

In addition, for convenience in use, the rotating wheel 35 has a part exposed to the outside of the handle 10. Preferably, the part of the rotating wheel 35 exposed to the outside of the handle 10 is provided thereon with a decorative pattern enhancing the friction.

When the second projection 3422 contacts the bending part 3122, the cam assembly 342 is clamped down due to the contact between the second projection 3422 and the bending part 3122, and at this time, the cam assembly 342 does not apply pressure against the tab 31. Herein, tab 31 has the trend of rotating away from the open side of handle 10 under the effect of the pulling force of the spring string 33, such that when the blade 20 is closed, the end 311 of the tab 31 adjacent to the blade 20 slightly contacts the blade 20 or is out of contact with it, resulting in that the tab 31 does not exert or exert little force on the blade 20. Consequently, during the opening of the blade 20, the tab 31 does not function as the assistant force, i.e. the fold knife 100 is under the manual operation condition. This manual operation condition is similar to that shown in FIG. 1D.

In addition, as shown in FIG. 3, when the rotating wheel 35 of the cam assembly 342 is rotating clockwise until the first projection 3421 contacts the extension part 312, the first projection 3421 presses against the extension part 312 therefore biasing the tab 31, such that when the blade 20 is closed, the end 311 of the tab 31 presses against the corresponding end of the blade 20 toward the open side of the handle 10. Consequently, during the opening of the blade 20, the tab 31 functions as the assistant force, i.e. the fold knife 100 is under the semi-automatic operation condition. This semi-automatic operation condition is similar to that shown in FIG. 1A-FIG. 1C.

Of course, the present embodiment is not limited to the above, for example, the first projection 3421 and the second projection 3422 may be provided as an extruding cylinder shape and the spring string 33 may be replaced by a coil spring, and so on.

Although the present invention has been described in conjunction with the figures and the preferable embodiments, it is obvious for those skilled in the art that various changes and variations can be made to the present invention without departing from the spirit and the scope of the present invention. All such changes and variations of the present invention are covered by the appended claims and the equivalent thereof.

What is claimed is:

1. A fold knife comprising:

a handle having an inner chamber;

a blade, hinged to the handle;

a switch mechanism for manual and semi-automatic operation, the switch mechanism substantially positioned in the inner chamber of the handle, the switch mechanism for manual and semi-automatic operation including a first position in which it is allowed to manually open the blade from the handle, and a second position in which it is allowed to semi-automatically open the blade from the handle, the switch mechanism including a switch member for operating the switch mechanism, the switch member including an engagement surface for actuating the switch member, the engagement surface having at least a portion disposed on the outside of the handle, actuation of the switching mechanism on the engagement surface changing the knife from manual operation to semi-automatic operation when the switch mechanism is in the first position and from semi-automatic operation to manual operation when the switch is in the second position.

2. The fold knife according to claim 1, wherein the switch mechanism for manual and semi-automatic operation includes:

a resilient portion pivotally mounted in the handle;

the switch member includes:

a first switch position in which when the blade is closed, the end of the resilient portion adjacent to the blade slightly contacts the blade or is out of contact with it, such that the switch mechanism for manual and semi-automatic operation is in the first position; and a second switch position in which the switch member biases the resilient portion such that when the blade is closed, the end of the resilient portion presses against the corresponding end of the blade toward the open side of the handle, and therefore the switch mechanism for manual and semi-automatic operation is in the second position.

3. The fold knife according to claim 2, wherein the switch member is a slider which is slidably connected to the handle by inserting projections provided on the opposed sides of the slider into the corresponding slot of the handle respectively.

4. The fold knife according to claim 3, wherein the switch member is provided on one side of the resilient portion opposed to the open side of the handle and is provided between the pivot axis of the resilient portion and the blade in a manner of approaching the pivot axis of the resilient portion.

5. The fold knife according to claim 3, wherein the resilient portion has an extension part at one side of the pivot axis of the resilient portion opposed to the blade and the switch member is provided below the extension part.

6. The fold knife according to claim 3, wherein at one of the first switch position and the second switch position corresponding to the switch member, the resilient portion is provided with a recess capable of accommodating the switch member.

7. The fold knife according to claim 2, wherein the switch member is a pin which is slidably connected to the handle by passing through a corresponding slot of the handle.

8. The fold knife according to claim 7, wherein the switch member is provided on one side of the resilient portion opposed to the open side of the handle and is provided between the pivot axis of the resilient portion and the blade in a manner of approaching the pivot axis of the resilient portion.

9. The fold knife according to claim 7, wherein at one of the first switch position and the second switch position corresponding to the switch member, the resilient portion is provided with a recess capable of accommodating the switch member.

10. The fold knife according to claim 2, wherein the resilient portion has an extension part on one side of the pivot axis of the resilient portion opposed to the blade, the tail tip of the extension part has a bending part toward the open side of the handle, and the switch member is a cam assembly, the cam assembly including:

a rotating wheel pivotally mounted in the handle wherein the pivot axis is provided below the extension; and a first projection and a second projection provided at the rotating wheel and forming an angle with respect to the center of the rotating wheel wherein the angle is set such that when the switch mechanism for manual and semi-automatic operation is in the first position, only the first projection contacts and presses against the extension and when the switch mechanism for manual and semi-automatic operation is in the second position, the second projection contacts the bending part.

11. The fold knife according to claim 2, wherein the resilient portion includes:

a tab pivotally mounted in the handle; and a pre-pulling member which is on one end fixed to the handle and on the other end fixed to the tab and allows the end of the tab adjacent to the blade to have the trend of rotating away from the open side of the handle.

12. The fold knife according to claim 11, wherein the pre-pulling member is a coil spring or spring string.

13. The fold knife according to claim 1, wherein the resilient portion has an extension part at one side of the pivot axis of the resilient portion opposed to the blade and the switch member is provided below the extension part.

* * * * *